US006115880A

United States Patent [19]

Wulff et al.

[11] Patent Number: 6,115,880

[45] Date of Patent: Sep. 12, 2000

[54] VACUUM CLEANER CONFIGURATION

[75] Inventors: Richard F. Wulff, Maple Plain, Minn.; Daniel G. Giddings, Holland, Mich.

[73] Assignee: Castex Incorporated, Holland, Mich.

[21] Appl. No.: 09/166,353

[22] Filed: Oct. 5, 1998

[51] Int. Cl.[7] ..... A47L 9/10

[52] U.S. Cl. ..... 15/351; 15/412

[58] Field of Search ..... 15/350, 351

[56] References Cited

U.S. PATENT DOCUMENTS

| | | | |
|---|---|---|---|
| 2,033,833 | 3/1936 | Kent | 15/350 X |
| 2,210,953 | 8/1940 | Replogle | 15/351 X |
| 2,269,482 | 1/1942 | Replogle | 15/350 X |
| 3,126,570 | 3/1964 | Green | 15/351 X |
| 3,344,460 | 10/1967 | Nordeen | 15/351 |
| 3,491,519 | 1/1970 | Ettridge | 15/350 X |
| 3,634,905 | 1/1972 | Boyd | 15/350 |
| 4,512,057 | 4/1985 | Laing et al. | 15/350 X |
| 4,517,705 | 5/1985 | Hug | 15/351 |
| 4,724,574 | 2/1988 | Bowerman et al. | 15/351 |
| 4,959,885 | 10/1990 | Sovis et al. | 15/350 X |

*Primary Examiner*—Chris K. Moore

*Attorney, Agent, or Firm*—Price, Heneveld, Cooper, DeWitt & Litton

[57] ABSTRACT

A floor cleaner comprising a base and a filter bag housing, the filter bag housing having a bag cavity which has an undulated inner wall for receiving a filter bag, the undulated wall having a plurality of elongated protrusions and adjacent intermediate elongated air flow recesses. A smooth outer wall is spaced from the inner wall.

45 Claims, 7 Drawing Sheets

VACUUM CLEANER CONFIGURATION

BACKGROUND OF THE INVENTION

This invention relates to upright carpet vacuum floor cleaners. Such cleaners typically have a base for engaging the floor and an upper filter bag housing. A filter bag is inserted into an open top of the housing, which is then closed by a cover. During operation, the filter bag has a negative pressure applied to its outer surface by a vacuum motor in the cleaner. This draws dirt laden air off the floor surface to the inside of the filter bag. The air flows through the filter bag exterior into the cleaner housing. The dirt is retained in the bag in well-known manner. It has been determined that air flow through the side walls of the filter bag in conventional cleaners has rather poor efficiency due to poor air flow characteristics. This is because the bag is drawn into engagement with the inner wall of the bag housing, thereby restricting air flow around its periphery. Another problem is that, once the bag is full of dirt, it is often difficult to remove it from the housing since it tends to frictionally cling to the housing wall.

SUMMARY OF THE INVENTION

The present invention employs a unique inner wall configuration for the bag housing that creates excellent air flow around the side walls of the bag, i.e., between the bag and the housing. Moreover, once the bag is full, it can be readily removed from the housing with a minimal amount of friction or resistance.

The housing has an inner undulated wall, formed of a plurality of elongated recesses and intermediate elongated protrusions. The recesses and protrusions are preferably in a generally sinusoidal pattern. The housing has dual inner and outer walls, each defining a selected thickness, defining an intermediate space therebetween. The inner wall defines a bag receiving space therein. The walls are integrally joined at the top of the inner and outer walls, and open between the bottom of the inner and outer walls. The bag receiving space is in flow communication with a duct leading to a vacuum motor pump. The outer wall has a smooth outer non-undulated surface. The dual wall is preferably roto-molded of a polymeric material.

These and other features, advantages and objects of the present invention will be further understood and appreciated by those skilled in the art by reference to the following specification, claims and appended drawings.

DETAILED DESCRIPTION OF PREFERRED EMBODIMENT

Referring now specifically to the drawings, the novel cleaner 10 has three major components or subassemblies, namely base subassembly 12, filter bag subassembly 14, and handle subassembly 16.

Figure 10:
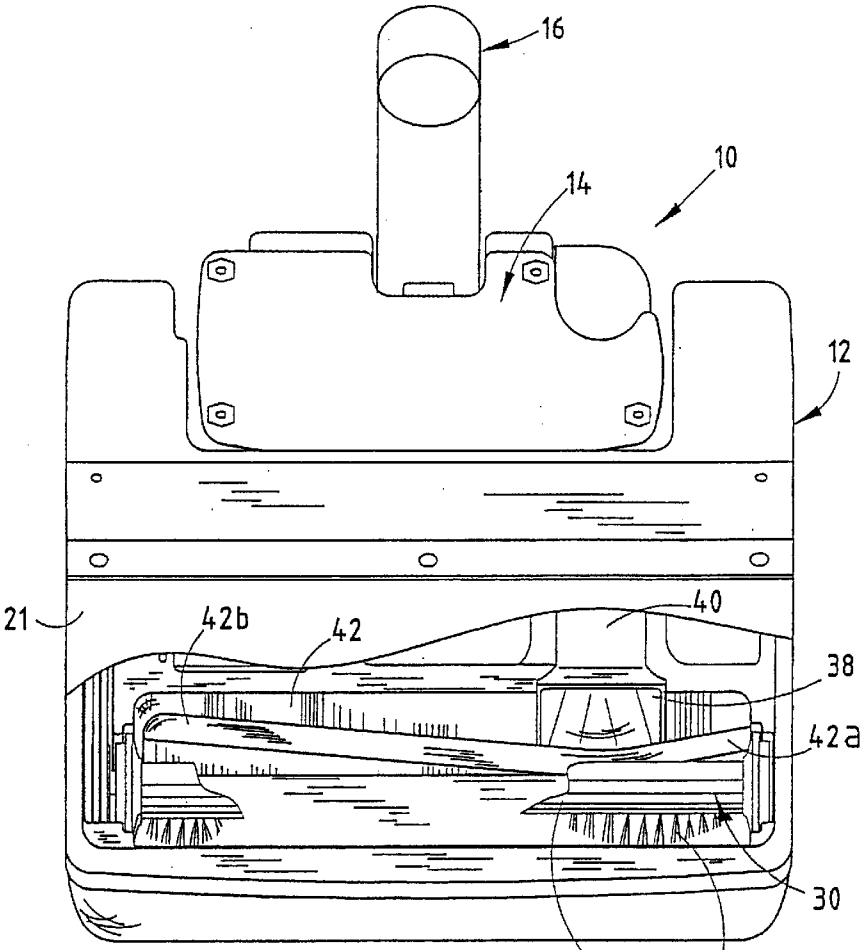
FIG. 10 is an enlarged bottom view of the cleaner showing the underside cover panel cut away.
Figure 4:
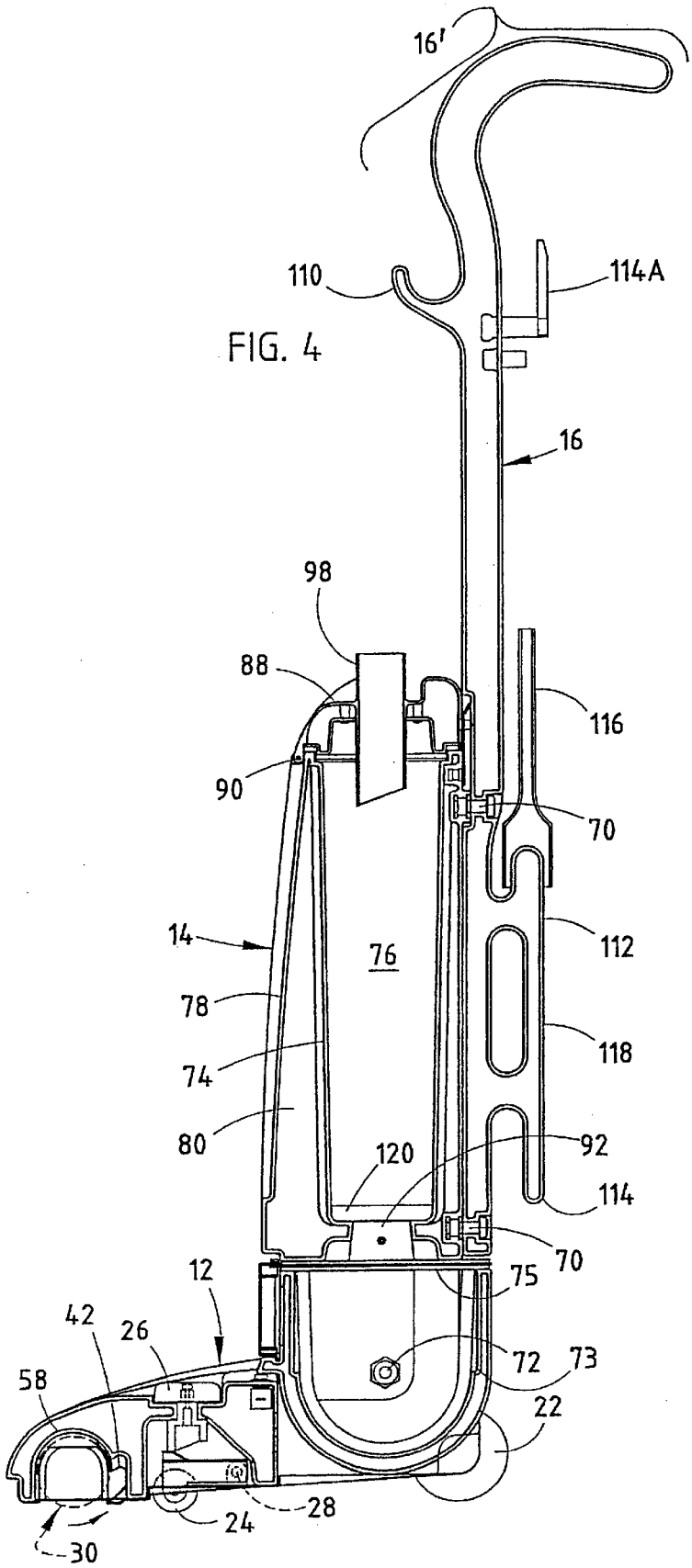
FIG. 4 is a side elevational sectional view of the cleaner.
Figure 8:
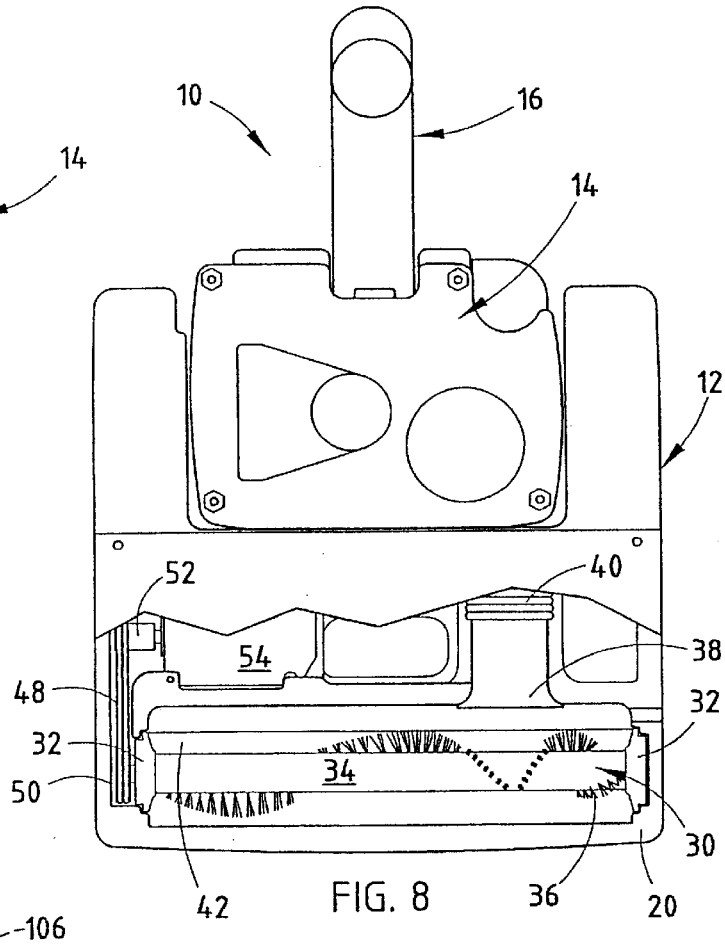
FIG. 8 is a bottom view of the cleaner.
Figure 9:
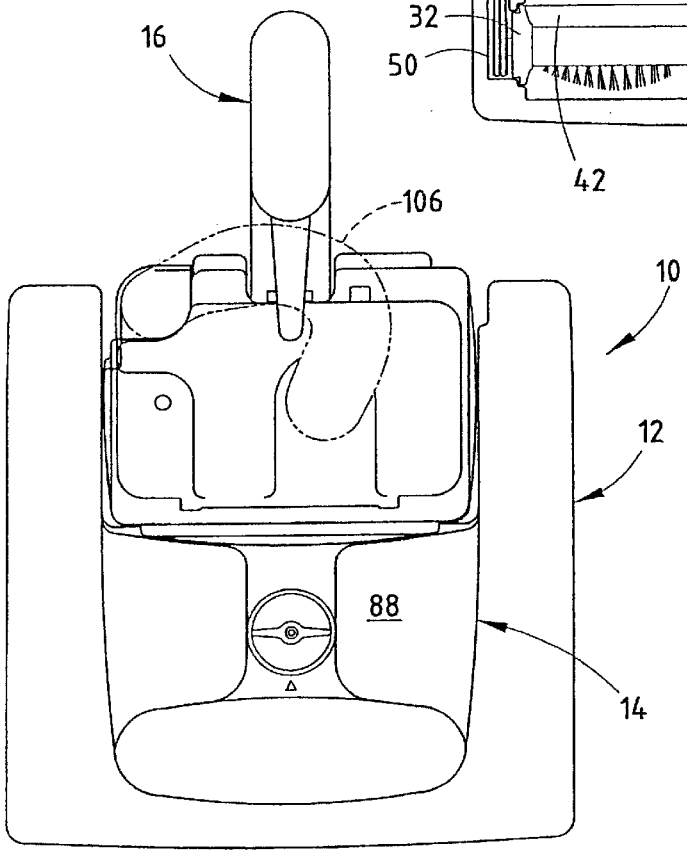
FIG. 9 is a top view of the cleaner.
Figure 12:
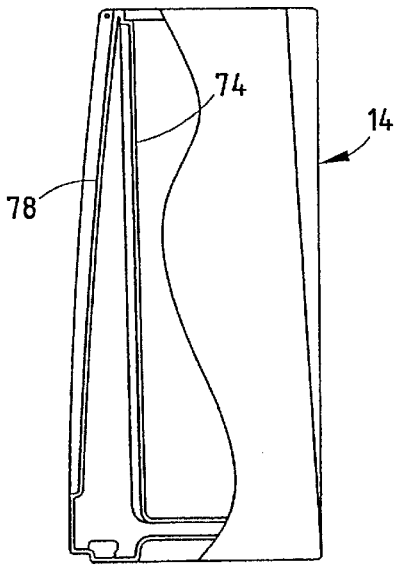
FIG. 12 is a side elevational view of the bag housing, partially cut away.

Base subassembly 12 comprises a base housing 20 which may be formed of various materials, but is preferably of roto-molded polymeric material. At the rear of this housing are rotationally mounted a pair of rear wheels 22. Midway between the rear and the front of the housing but offset more toward the front of the housing is a roller 24 (FIG. 4). Roller 24 is adjustable vertically by knob 26, to be moved vertically around pivot point 28 for controlling the degree of engagement of cleaning brush 30 with the floor surface to be cleaned. Cleaning brush 30 comprises an elongated cylindrical element extending across the front of the base (FIGS. 8 and 10) and mounted in end bearings 32. It has an elongated cylindrical hub 34 and radially projecting bristles 36 in a double helical pattern. The helical pattern of the bristles is in two opposite helical directions from the two opposite ends, the two patterns meeting at the area adjacent inlet nozzle 38 of duct 40. Typically the brush rotates in a direction such that the bristles move downwardly at the front of the brush and upwardly at the rear of the brush. These two portions of helical pattern brushes cooperate with a special reflector ledge 42 in a manner to be described hereinafter. Brush 30 is rotated by belts 48 on pulley 50 at the end of the brush, the belts being driven by pulley hub 52 on electric motor 54 retained within a motor receiving chamber of housing 20. Beneath motor 54 and some other portions of housing 20 is a removable underside cover panel 21. Brush 30 is exposed through an elongated opening in the panel.

Housing 20 defines a generally semi-cylindrical, elongated brush receiving cavity 58 (FIG. 4) that extends transversely of the housing and receives brush 30. It is open on the bottom to allow peripheral brush bristle engagement with the carpeted floor surface to be cleaned. Extending transversely across the housing at the rear of brush receiving cavity 58 is a special particle reflection and air tunnel ledge 42 (FIGS. 4, 8, and 10), which cooperates with brush 30 and suction nozzle 38. The particle reflection and air tunnel ledge has an upwardly concave, elongated configuration (see FIG. 4) that cooperates with the brush bristles to create air tunnel-like air flow along its length, i.e., generally parallel to the brush axis, toward nozzle 38. Nozzle 38 is located between the two ends of brush 30, typically offset more toward one end than the other. Two portions 42*a* and 42*b* of elongated reflection ledge 42 meet adjacent nozzle 38. Inverted reflector ledge 42, which is about 0.030 inch from the periphery of the brush bristles, preferably slopes upwardly from both ends thereof (FIG. 10) to an apex in front of nozzle 38. In the embodiment depicted, portion 42*a* of ledge 42 is considerably shorter than portion 42*b* extending from the opposite end, so as to meet in front of nozzle 38. The concave surface of inverted ledge 42 also slopes rearwardly upwardly from its forward apex as depicted in FIG. 4. Its position close to the brush bristles causes this reflector surface to be engaged by rising sand, pea gravel, ice melt, and salt pellet particles propelled by brush 30 as the brush rotates rearwardly during operation of the cleaner. These particles are reflected into the concave space to be advanced by the axial air flow along the reflection ledge. It has been found that the use of the special particle reflector and air tunnel ledge, in combination with the closely adjacent helical brush characteristics, causes even larger particles to progressively bounce off the reflective ledge, each bounce bringing the particles closer to nozzle 38 so that ultimately the particles are drawn through nozzle 38 and duct 40 toward a dirt retaining receptacle in bag housing 14.

Figure 1:
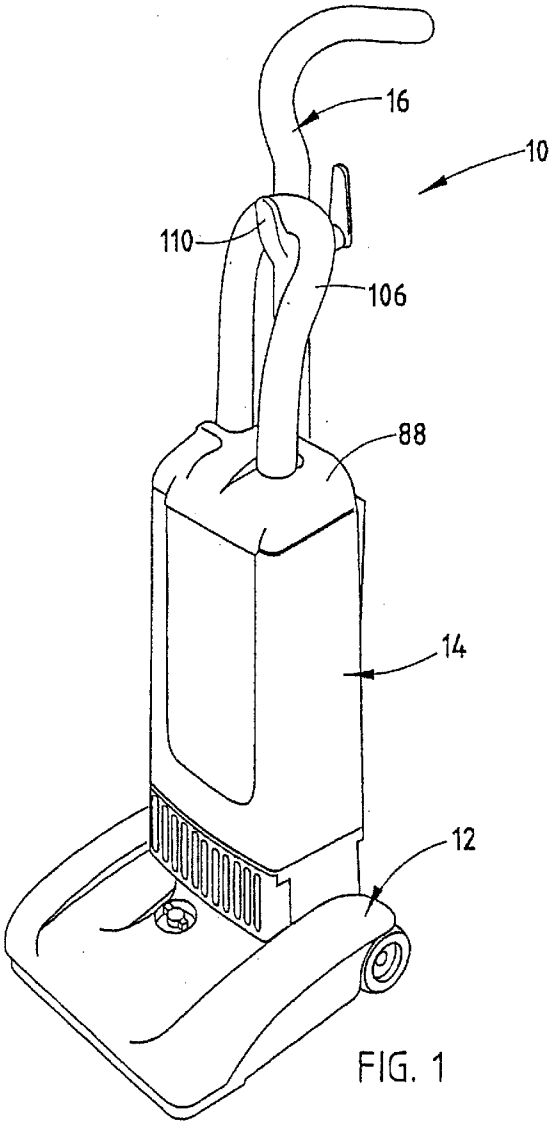
FIG. 1 is a perspective view of the novel cleaner.
Figure 2:
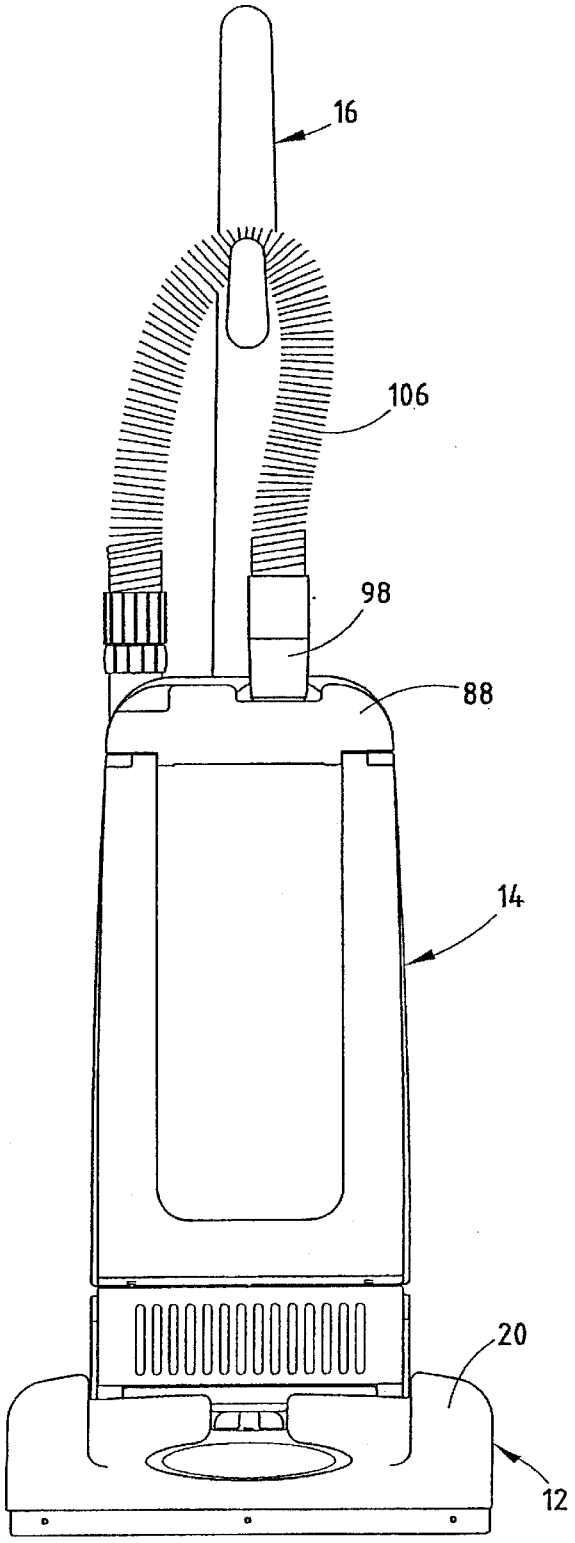
FIG. 2 is a front elevational view of the cleaner.
Figure 3:
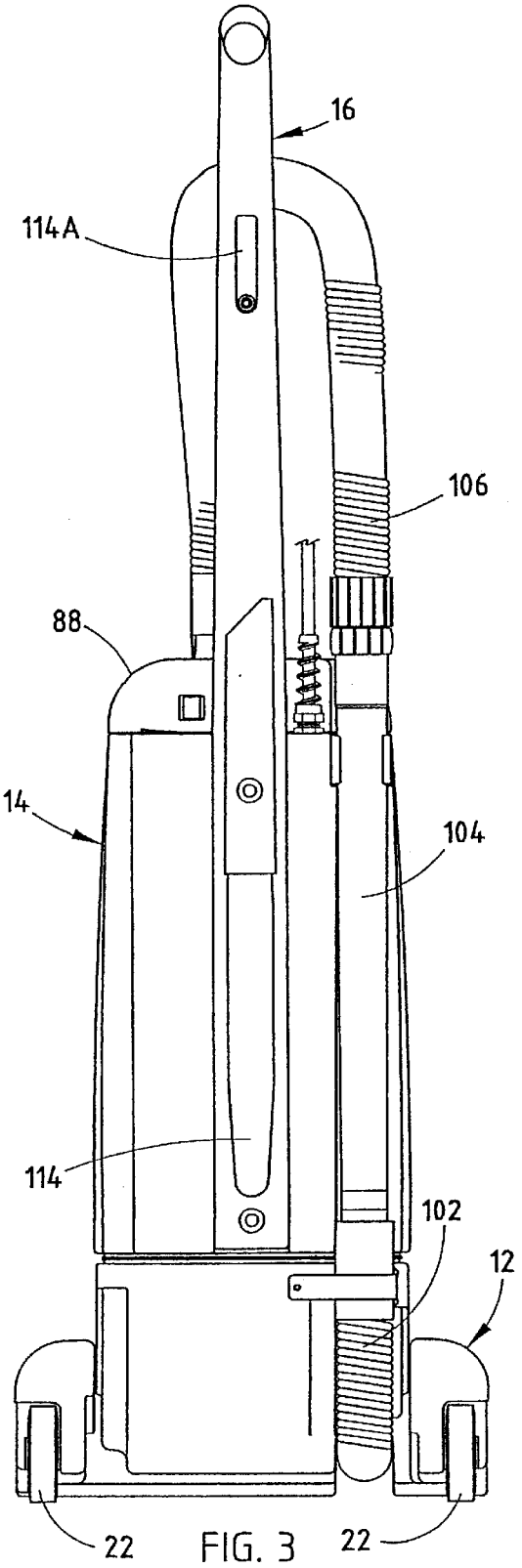
FIG. 3 is a rear elevational view of the cleaner.

Upright dirt retention housing 14, preferably formed of roto-molded polymeric material such as polyethylene, has handle subassembly 16 attached to it by fasteners 70 (FIG. 4). Housing 14 and handle 16 are pivotally attached at pivots 72 to base 12, to enable the housing and handle to be pivoted between an upright storage condition and a plurality of lowered upwardly-rearwardly sloping conditions, the most common of which is shown as the intermediate position in phantom lines in FIG. 6. If necessary, housing 14 and handle 16 can be lowered to the maximum amount depicted adjacent the floor surface in FIG. 6. Bag housing 14 (FIG. 4) has a peripherally enclosing inner wall 74 of significant thickness, defining a bag receiving chamber 76 therein. The housing also includes an outer wall 78 of significant thickness integrally joined at the top with inner wall 74 and spaced from the inner wall over its length, including at the bottom of the two walls, to define a space 80 therebetween. The outer surface of outer wall 78 is smooth as shown in FIG. 1, preferably having a front surface, a rear surface, and two side surfaces, all of which are generally planar. The inner wall 74 has an undulating characteristic, preferably generally sinusoidal along its two side walls, its front wall, and its back wall as depicted in FIG. 7. The corners are preferably diagonally positioned. These undulations define a plurality of vertically elongated recesses 84 and inwardly projecting, intermediate, vertically elongated protrusions 86. Placement of a dirt bag inside housing 14 is achieved by opening a pivotal cover 88 (FIG. 4) about frontal pivot point 90 to open the housing top for access to space 76. Recesses 84 provide excellent airflow passages adjacent the outer side walls of the dirt bag (not shown) placed in space 76. At the bottom of space 76 is the bag housing vacuum outlet 92 (FIG. 7), which communicates through a lateral passage 93 (FIG. 5) with vacuum motor and pump unit 94 (FIG. 5) to create a negative pressure, i.e., partial vacuum, around the bag exterior inside chamber 76. The porous dirt bag causes a lower negative pressure inside the bag. At the top of housing 14, extending through cover 88, is a tube 98 which serves as the inlet tube for dirt-laden air flow drawn from brush chamber 58 through nozzle 38, duct 40, hose 102 (FIG. 3), duct 104, and hose 106, to tube 98 and hence to chamber 76. It has also been determined that the undulation configuration of inner wall 74 allows easy removal of a filled dirt bag from chamber 76, because of minimal friction between wall 74 and the bag.

Figure 5:
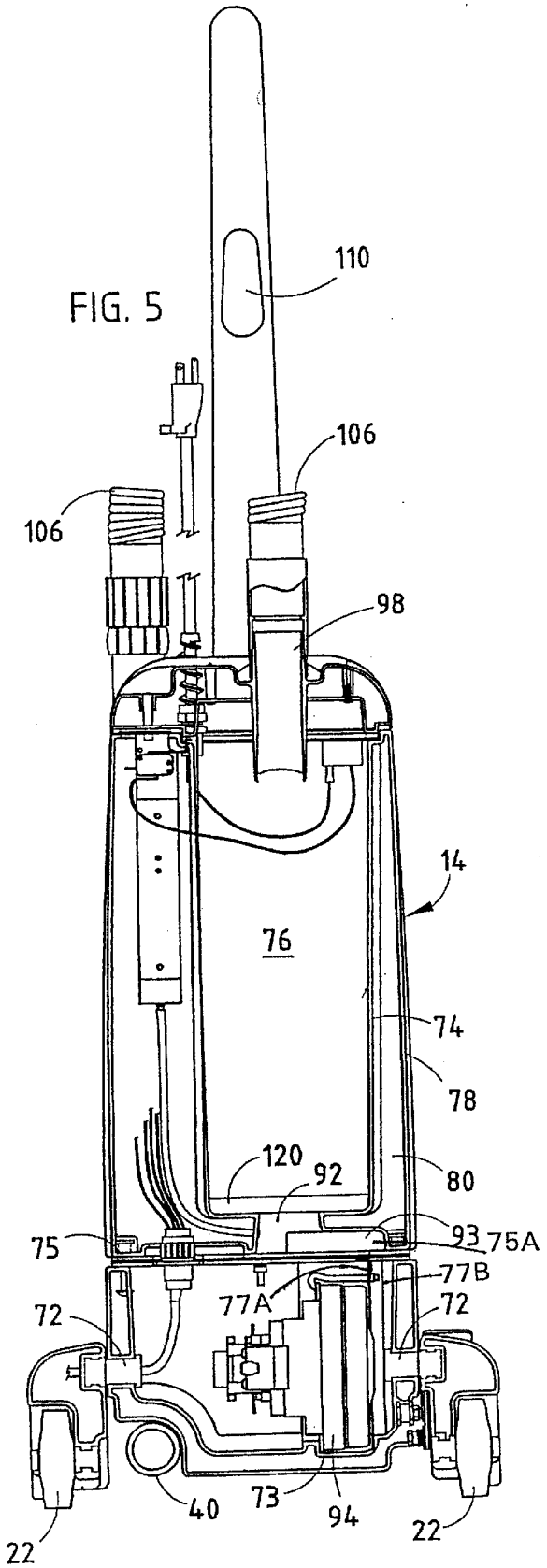
FIG. 5 is a front elevational sectional view of the cleaner.

Housing 14 has a chamber 73 which is specially configurated to receive and retain the vacuum motor and pump 94, as can be seen in FIGS. 4 and 5. Chamber 73 has a first wall 77A and a second wall 77B enclosing the vacuum motor and pump 94. The space enclosing the vacuum motor and pump 94 within the first wall 77A and the second wall 77B is in fluid communication with the space in front of the intake to the vacuum motor and pump 94. Its bottom and side walls are curved to match the motor and pump so that no added fasteners need be used to retain them in position. The top is closed by a cover plate 75, which has an aperture 75A which connects the vacuum motor and pump 93 with the chamber 76.

Handle 16 has a unique configuration and preferably is formed of molded polymer material. The handle extends upwardly above housing 14 when the cleaner is in the upright storage condition depicted in FIGS. 4 and 6. The handle extends upwardly above housing 14 in a vertical orientation, curves slightly forwardly near the top of the handle, then through an approximate 90 degree arc, and extends horizontally to the rear. The arcuate portion and horizontal extension constitute a hand grip zone 16'. The span of this arcuate portion is at least as large as the width of an adult human hand, i.e., about three inches or greater, to function effectively and comfortably. The diameter of the handle at the hand grip zone is at least about one inch and is preferably about one and one-half inches. When the cleaner is lowered to the normal operating condition shown as the intermediate position in FIG. 6, handle 16 then extends diagonally upwardly-rearwardly, then slightly upwardly to blend into the 90° arcuate portion, and then extends diagonally downwardly rearwardly. This sloped downwardly-rearwardly orientation has been found to be ergonomically advantageous to accommodate the normal hand position of an operator during the constant push-and-pull movement of the cleaner across the floor. If the cleaner housing and handle need to be lowered further, e.g., to positions between the two phantom line depictions in FIG. 6, the curved arcuate portion still constitutes an ergonomically correct position as a hand grip for the hand of the operator. Consequently, the operator will experience considerably less fatigue. The cross-sectional configuration of handle 16 is preferably substantially circular in the hand grip region, and can gradually converge into a more oval configuration as shown by the sectional views 16*a*–16*h*. Optionally, the topmost portion can be slightly oval in configuration with a larger vertical axis than transverse axis.

Figure 6:
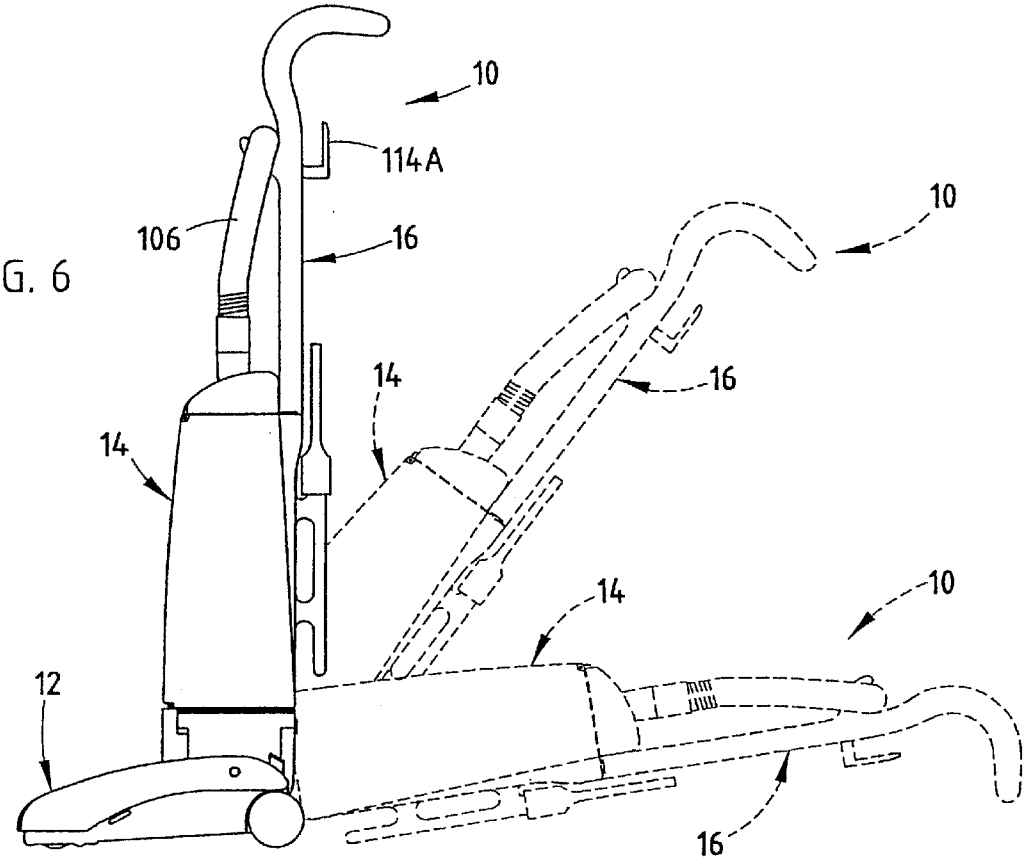
FIG. 6 is a side elevational view of the cleaner showing it in three positions.
Figure 7:
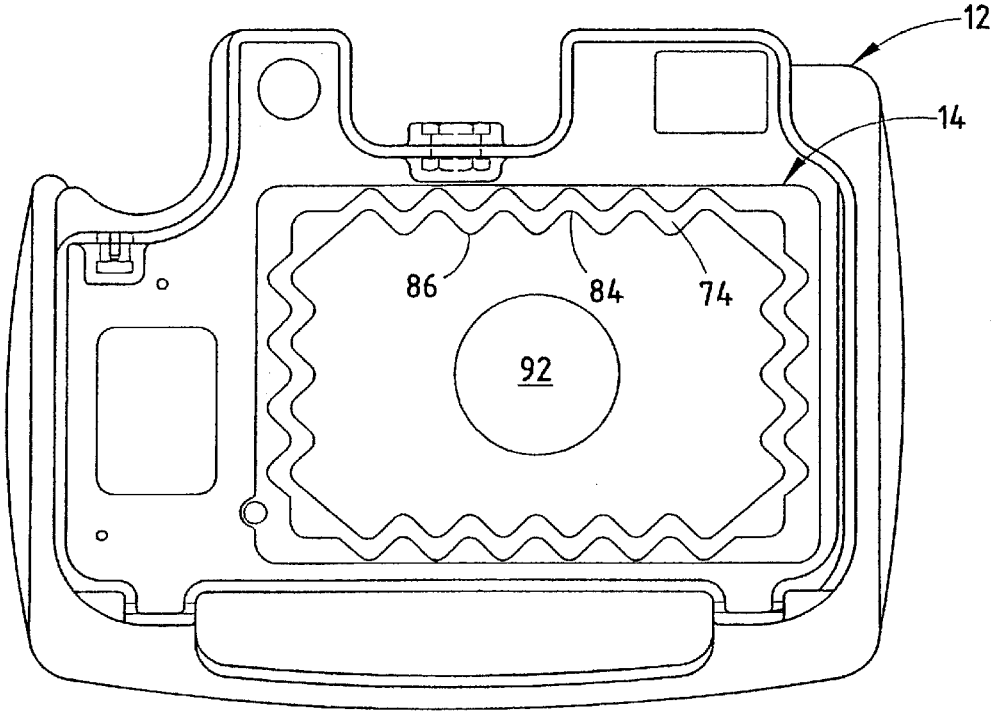
FIG. 7 is a top plan view of the bag housing.
Figure 11:
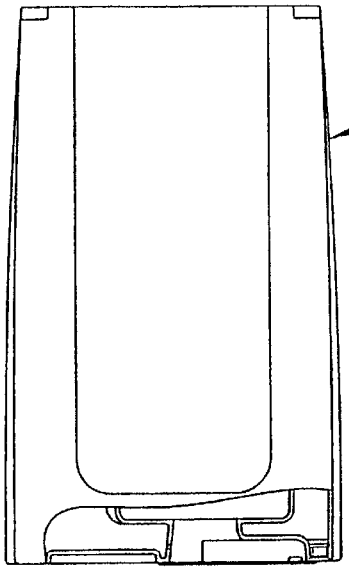
FIG. 11 is a front elevational view of the bag housing, partially sectioned.
Figure 13:
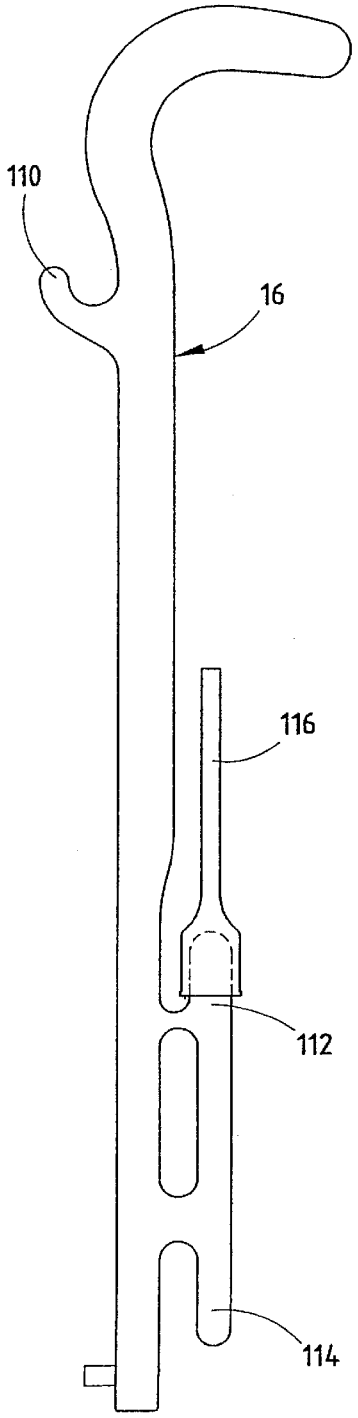
FIG. 13 is a side elevational view of the handle.
Figure 14:
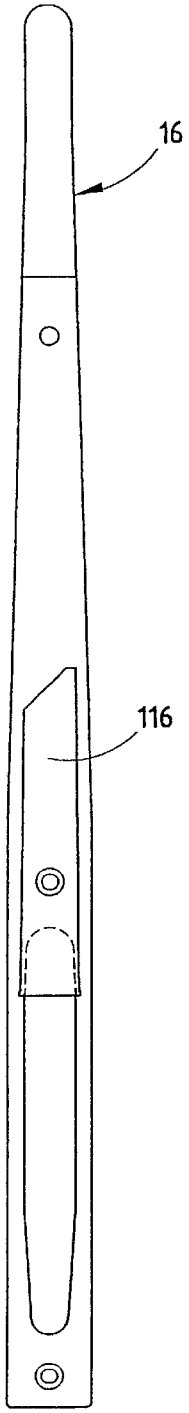
FIG. 14 is a rear elevational view of the handle.
Figure 15:
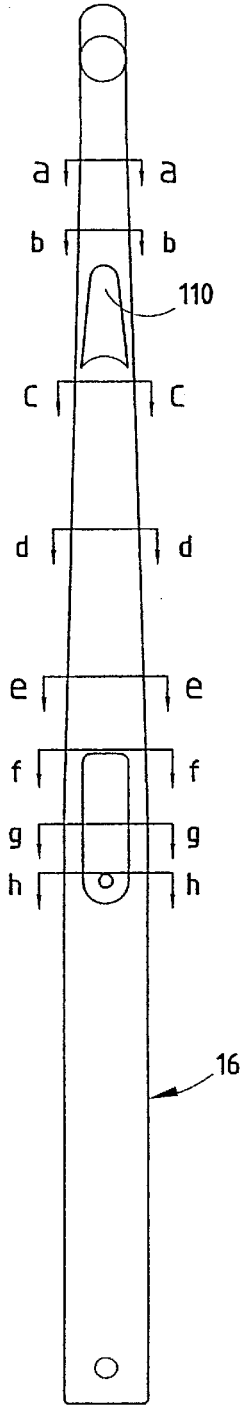
FIG. 15 is a front elevational view of the rear handle.
Figure 16A:
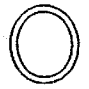
FIGS. 16A–16H are sectional views taken at various places through the handle in FIG. 15.
Figure 16B:
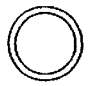
Figure 16C:
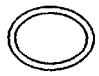
Figure 16D:
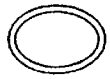
Figure 16E:
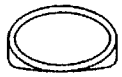
Figure 16F:
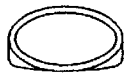
Figure 16G:
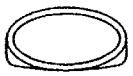
Figure 16H:
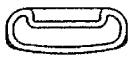

Integrally formed into the front of the upper portion of handle 16 is an upstanding hose hook 110 (FIG. 13) for draping of the vacuum hose 106 thereover as shown in FIG. 6. On the rear side of handle 16, near the upper end thereof, is an upstanding hook 114A cooperable with a lower, downwardly projecting hook 114, to serve as a cord windup zone for the electrical cord. An integral carrying handle portion 118 projecting rearwardly of handle 16 includes an upstanding hook 112 to retain a standard fitting 116. This fitting may be used for attachment to the hose to clean corner areas or the like.

During operation, a bag is placed in space 76 by pivotally opening cover 88 to provide an open top to space 76, after which the cover is pivoted closed to seal around the bag upper surface. Power is then applied to the cleaner to actuate the vacuum motor and pump unit 94, as well as electric motor 54 which drives brush 30. The operator then moves the bag housing and handle from the upright storage position to a rearward diagonal position, such as the middle position shown in FIG. 6, and pushes and pulls the cleaner back and forth across the floor surface to be cleaned. The operator's hand can slide readily from the rearmost, substantially straight portion of the handle to and from the arcuate portion, if desired. Rotating brush 30, when encountering difficult-to-retrieve particles such as sand, salt pellets, and the like, will auger the particles from both ends of brush 30 toward nozzle 38 by bouncing the particles repeatedly off inverted ledge 42, the particles advancing longitudinally along the upwardly sloped concave ledge to nozzle 38, assisted by the air flow through the concave ledge space, and hence to duct 40, from whence it moves ultimately to tube 98 into the dirt bag. Negative pressure is created in the dirt bag by the vacuum motor drawing air from the undulation recesses 84 for efficient drawing of the air through the porous bag wall which filters out the dirt. A secondary filter 120 is preferably placed over vacuum outlet 92 at the bottom of space 76 (FIG. 4). If desired, a third filter can be placed upstream of vacuum pump 94. When the dirt bag is full, as indicated by a yellow light which can be used to signal a full or a clogged bag, the unit is shut down, cover 88 is pivotally opened, and the filled dirt bag is removed, this removal being readily done because of minimal friction of the bag on the protrusions 86.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The invention claimed is:

1. A floor cleaner comprising:

a base and a filter bag housing;

said filter bag housing having a bag cavity, said bag cavity having a non-perforated undulated inner wall for receiving a filter bag, said non-perforated undulated inner wall having a plurality of elongated protrusions and adjacent elongated air flow recesses;

said bag cavity further having an outer wall, said outer wall and said non-perforated inner wall defining a space therebetween.

2. The floor cleaner in claim 1 wherein said filter bag housing is of molded polymer.

3. The floor cleaner in claim 2 wherein said filter bag housing is of roto-molded polymer.

4. The floor cleaner in claim 1 wherein said outer wall has a generally smooth non-undulated exterior surface.

5. The floor cleaner in claim 1 including a vacuum motor and a passage, said passage being in air flow communication with said cavity for causing dirt laden air flow from a filter bag in said housing into said passage.

6. The floor cleaner in claim 5 wherein said filter bag housing is of molded polymer.

7. The floor cleaner in claim 6 wherein said non-perforated undulated inner wall and said outer wall have integrally connected upper end portions defining an open filter-bag-receiving top.

8. The floor cleaner in claim 7, wherein said non-perforated undulated inner wall defines an open bottom area in air flow communication with said passage.

9. The floor cleaner in claim 7 wherein said housing includes a cover for said open top.

10. The floor cleaner in claim 1 wherein said non-perforated undulated inner wall is undulated in a generally sinusoidal pattern.

11. The floor cleaner in claim 1 wherein said filter bag housing is of roto-molded polymer.

12. An upright floor cleaner comprising:

a base having a powered brush;

a filter bag housing above said base; and a vacuum motor and pump in said housing;

said housing having a non-perforated inner wall defining a bag cavity, and an outer wall generally spaced from said inner wall;

wherein a portion of said inner wall is joined to a portion of said outer wall; and wherein said inner and outer walls are integrally joined at the top thereof.

13. The upright floor cleaner in claim 12 wherein said housing comprises a unitary molded structure including said inner and outer walls.

14. The upright floor cleaner in claim 13 wherein said housing is of roto-molded polymer.

15. The upright floor cleaner in claim 13 wherein said inner wall has vertically oriented undulations formed of protrusions and adjacent elongated air flow recesses, and said outer wall has a smooth outer surface.

16. The upright floor cleaner in claim 12 wherein said housing is a molded structure.

17. The upright floor cleaner in claim 16 wherein said housing has a retention cavity configured to interfit with and retain said vacuum motor and pump.

18. The upright floor cleaner in claim 17 including a cover on said retention cavity, said vacuum motor and pump being free of fasteners to said housing.

19. The upright floor cleaner in claim 17 including an air outlet from said bag cavity in said bag housing, and an air passage from said air outlet to said retention cavity for said vacuum motor and pump to draw air from said bag cavity.

20. The upright floor cleaner in claim 19 wherein said bag housing and said base member are of molded polymer, and said air outlet and said air passage are integrally formed in said molded polymer.

21. An upright floor cleaner comprising:

a base having a powered brush;

a filter bag housing above said base;

a vacuum motor and pump in said housing;

said housing having an inner wall defining a bag cavity, and an outer wall generally spaced from said inner wall;

wherein one portion of said inner wall is joined to one portion of said outer wall; and wherein said housing comprises a unitary molded structure including said inner and outer walls;

wherein said housing has a retention cavity configured to interfit with and retain said vacuum motor and pump; and a cover on said retention cavity, said vacuum motor and pump being free of fasteners to said base housing.

22. The upright floor cleaner in claim 21 wherein said housing is of roto-molded polymer.

23. The upright floor cleaner in claim 21 wherein said inner wall has vertically oriented undulations formed of protrusions and adjacent elongated air flow recesses, and said outer wall has a smooth outer surface.

24. The upright floor cleaner in claim 21 including an air outlet from said bag cavity in said bag housing, and an air passage from said air outlet to said retention cavity for said vacuum motor and pump to draw air from said bag cavity.

25. The upright floor cleaner in claim 24 wherein said bag housing and said base member are of molded polymer, and said air outlet and said air passage are integrally formed in said molded polymer.

26. An upright floor cleaner comprising:

a base having a powered brush;

a filter bag housing above said base; and a vacuum motor and pump in said housing;

said housing having a non-perforated inner wall defining a bag cavity, and an outer wall generally spaced from said inner wall;

wherein a portion of said inner wall is joined to a portion of said outer wall wherein said housing is a molded structure; and wherein said housing has a retention cavity configured to interfit with and retain said vacuum motor and pump.

27. The upright floor cleaner in claim 26 wherein said housing comprises a unitary molded structure including said inner and outer walls.

28. The upright floor cleaner in claim 27 wherein said housing is of roto-molded polymer.

29. The upright floor cleaner in claim 27 wherein said inner wall has vertically oriented undulations formed of protrusions and adjacent elongated air flow recesses, and said outer wall has a smooth outer surface.

30. The upright floor cleaner in claim 26 including a cover on said retention cavity, said vacuum motor and pump being free of fasteners to said housing.

31. The upright floor cleaner in claim 26 including an air outlet from said bag cavity in said bag housing, and an air passage from said air outlet to said retention cavity for said vacuum motor and pump to draw air from said bag cavity.

32. The upright floor cleaner in claim 31 wherein said bag housing and said base member are of molded polymer, and said air outlet and said air passage are integrally formed in said molded polymer.

33. An upright floor cleaner comprising:

a base having a powered brush;

a filter bag housing above said base; and a vacuum motor and pump in said housing;

said housing having a non-perforated inner wall defining a bag cavity, and an outer wall generally spaced from said inner wall;

wherein a portion of said inner wall is joined to a portion of said outer wall;

wherein said housing comprises a unitary molded structure including said inner and outer walls; and wherein said inner wall has vertically oriented undulations formed of protrusions and adjacent elongated air flow recesses, and said outer wall has a smooth outer surface.

34. The upright floor cleaner in claim 33 wherein said housing is of roto-molded polymer.

35. The upright floor cleaner in claim 33 wherein said housing has a retention cavity configured to interfit with and retain said vacuum motor and pump.

36. The upright floor cleaner in claim 35 including a cover on said retention cavity, said vacuum motor and pump being free of fasteners to said housing.

37. The upright floor cleaner in claim 35 including an air outlet from said bag cavity in said bag housing, and an air passage from said air outlet to said retention cavity for said vacuum motor and pump to draw air from said bag cavity.

38. The upright floor cleaner in claim 35 wherein said bag housing and said base member are of molded polymer, and said air outlet and said air passage are integrally formed in said molded polymer.

39. An upright floor cleaner comprising:

a base having a powered brush;

a filter bag housing above said base; and a vacuum motor and pump in said housing;

said housing having an inner wall defining a bag cavity, and an outer wall generally spaced from said inner wall;

wherein one portion of said inner wall is joined to one portion of said outer wall;

wherein said housing comprises a unitary molded structure including said inner and outer walls; and wherein said inner wall has vertically oriented undulations formed of protrusions and adjacent elongated air flow recesses, and said outer wall has a smooth outer surface.

40. The upright floor cleaner in claim 39 wherein said housing is of roto-molded polymer.

41. The upright floor cleaner in claim 39 wherein said housing has a retention cavity configured to interfit with and retain said vacuum motor and pump.

42. An upright floor cleaner comprising:

a base having a powered brush;

a filter bag housing above said base; and a vacuum motor and pump in said housing;

said housing having an inner wall defining a bag cavity, and an outer wall generally spaced from said inner wall;

wherein one portion of said inner wall is joined to one portion of said outer wall;

wherein said housing comprises a unitary molded structure including said inner and outer walls;

wherein said housing has a retention cavity configured to interfit with and retain said vacuum motor and pump; and including an air outlet from said bag cavity in said bag housing, and an air passage from said air outlet to said retention cavity for said vacuum motor and pump to draw air from said bag cavity.

43. The upright floor cleaner in claim 42 wherein said housing is of roto-molded polymer.

44. The upright floor cleaner in claim 42 wherein said inner wall has vertically oriented undulations formed of protrusions and adjacent elongated air flow recesses, and said outer wall has a smooth outer surface.

45. The upright floor cleaner in claim 42 wherein said bag housing and said base member are of molded polymer, and said air outlet and said air passage are integrally formed in said molded polymer.

* * * * *

UNITED STATES PATENT AND TRADEMARK OFFICE

CERTIFICATE OF CORRECTION

PATENT NO. : 6,115,880
DATED : September 12, 2000
INVENTOR(S) : Richard F. Wulff et al.

It is certified that error appears in the above-identified patent and that said Letters Patent is hereby corrected as shown below:

Col. 7, claim 38, line 52;
"claim 35" should be --claim 37--.

Col. 8, after claim 45, insert claim 46;
--46. The upright floor cleaner in claim 33, wherein said housing is a molded structure.--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*